United States Patent [19]

Mess

[11] 4,084,780

[45] Apr. 18, 1978

[54] CAVITY FORMING PLUG FOR COIL INSERT IN CONCRETE PRODUCT

[75] Inventor: Richard C. Mess, Washington Township, Montgomery County, Ohio

[73] Assignee: The Dayton Sure-Grip & Shore Company, Miamisburg, Ohio

[21] Appl. No.: 761,262

[22] Filed: Jan. 21, 1977

[51] Int. Cl.[2] ..... B28B 7/30

[52] U.S. Cl. ..... 249/59; 52/125; 52/701; 52/705; 249/91; 249/177; 249/183; 249/186

[58] Field of Search ..... 249/59, 91, 177, 183, 249/186, 205, 207, 210; 52/125, 705, 699-701

[56] References Cited

U.S. PATENT DOCUMENTS

| | | | |
|---|---|---|---|
| 2,880,608 | 4/1959 | Boll et al. | 52/705 |
| 3,216,171 | 11/1965 | Jenkins | 52/705 |
| 3,590,538 | 7/1971 | Holt | 52/705 |
| 3,742,661 | 7/1973 | Tye | 52/705 |
| 3,889,916 | 6/1975 | Ilukowicz | 249/59 |

*Primary Examiner*—Francis S. Husar
*Assistant Examiner*—John McQuade
*Attorney, Agent, or Firm*—Biebel, French & Nauman

[57] ABSTRACT

A plug assembly, for temporary use with a concrete product insert having a coil defining an interior threaded surface, holds the insert in position adjacent a mold wall and prevents the interior of the coil from being filled with concrete. The plug assembly includes a plug having a hollow cylindrical elastomeric body defining a cavity which is open at one end of the body and a stem in the cavity attached to the body internally and extending out of the cavity a distance sufficient to provide for use of the stem as a handle. The outer surface of the cylindrical, elastomeric body is proportioned and threaded for firm matching engagement with the threaded coil interior surface upon predetermined radial compression and axial expansion of the body from its substantially unstressed condition. A support means has a first portion for insertion into the cavity in the elastomeric body and a second portion for attachment to a mold wall. The support means may be removed from the cavity as the mold wall is removed from the concrete product, and the plug may thereafter be removed from the coil by applying a pulling force to the stem. By use of a cavity closure means, such as a disc having a central opening for surrounding the stem, the plug may be used without the support means in a concrete product insert of the type which is positionable with the coil held vertically in the mold. The disc has a central opening for surrounding the stem and the diameter of the central opening is less than the unstressed diameter of the stem such that the disc will be held firmly by the plug.

12 Claims, 10 Drawing Figures

CAVITY FORMING PLUG FOR COIL INSERT IN CONCRETE PRODUCT

BACKGROUND OF THE INVENTION

This invention relates to the handling of cast concrete building products used in pre-cast and tilt-up construction, and more particularly, to a plug assembly for use with a coil insert which is embedded in the product and to which a hoisting means for lifting the product may be attached.

In recent years, pre-cast concrete products have been used widely by the building industry. Various building components, such as steps, may be cast in a mold and then transported to the construction site. In order to be able to handle these components easily, it is necessary to provide a means of attaching a crane cable to them. One or more inserts may be permanently embedded in the product for receiving a bolt-on lifting attachment.

A form of building construction referred to as the tilt-up method has also come into rather wide usage in which large concrete slabs are formed either on the floor of the building or on a level ground surface. The concrete slabs are then lifted into a vertical position and interconnected to form the walls of the building. Other types of building products may also be formed in this manner, such as columns.

The slabs are lifted by a crane, and a means of connecting the crane cable to the slabs must be provided. Generally an insert is permanently embedded in the slab, and lifting attachments, such as a lift ring and bolt, are attached to the insert. These attachments must be removable after the product has been lifted into place in order to provide a finished appearance for the building. Since the attachments are installed and removed at the building site, they are designed to be installed and removed quickly.

When the lifting attachments are removed from the slab or other product, a hole where the insert is located remains in the product and must be filled to provide a smooth surface. The insert should, therefore, be small enough to be concealed after the slab or other product has been installed, and yet should be sufficiently sturdy to sustain the forces of lifting heavy concrete products. Also, the insert should not interfere with rapid attaching and detaching of the lifting means.

Various types of inserts have been developed and are used in pre-cast and tilt-up building construction. One type of insert is designed to be positioned on the floor of the slab mold to provide a means of crane cable connection for lift-up construction. It includes several leg portions which hold a coil having a number of turns of heavy wire or rod stock. This coil provides an interior threaded opening in the top of the poured slab into which an attachment bolt may be threaded for lifting the product for tilt-up construction. The leg members are welded to the coil at the appropriate height above the mold floor so that the coil will be positioned just below the upper surface of the slab.

A number of different type of plugs have been designed to prevent access of fluid concrete to the interior of the insert coil as the concrete is poured into the mold. Among patents showing a plug with special characteristics for this purpose are U.S. Pat. No. 2,880,608, issued Apr. 7, 1959, to Boll et al, U.S. Pat. No. 3,216,171, issued Nov. 9, 1965, to Jenkins, U.S. Pat. No. 3,590,538, issued July 6, 1971, to Holt, and U.S. Pat. No. 3,742,661, issued July 3, 1973, to Tye. The plugs of all of such patents, however, offer certain disadvantages from the standpoint of both costs and simplicity of use.

Boll et al discloses the use of a filter plug described as composed of sponge rubber or some easily compressed rubber or elastic material allowing the plug to be inserted easily, and yet to be removed subsequently. Boll, however, does not teach how to insert or to remove the plug and, apparently, it would have to be crammed into the coil and, subsequently, dug out in piecemeal fashion. Each of the other three patents shows a two-part plug which must be separately threaded or otherwise fitted in place at opposite ends of the coil prior to installation, with the outer plug being removed after the concrete has set, but with the inner plug remaining in place for partial destruction by a coil bolt as it is threaded into the insert.

Another type of insert which is used primarily with pre-cast products is termed an edge pick-up insert. This type of insert provides a means of attaching a bolt to the edge of a product after the wood mold is removed. An edge pick-up insert has a coil for attachment to a coil bolt, such as described above. Edge pick-up inserts, however, generally do not have leg members but rather have a loop of wire which is welded to the insert coil. The loop insures that the insert is firmly embedded in the concrete. One or more such inserts may be fastened together by rods which are welded to the coils and extend between the inserts.

Since edge inserts of this type are designed to be positioned in the poured product with the coil adjacent a mold wall defining an edge of the product, means must be provided for holding the edge insert in the desired position while the product is poured. In the past, a plug having a threaded portion for engaging the coil has been screwed into the coil. the plug has then been nailed to the side of the mold wall and thereby provides the needed support for the associated insert.

In U.S. Pat. No. 3,889,916, issued June 17, 1975, to Ilukowicz, a protective plug for an edge pick-up concrete coil insert is disclosed which is made of plastic and is intended to be nailed to the mold wall. The plug has a threaded portion which is screwed into the coil and prevents concrete from entering the interior of the coil. A cavity is thus provided for insertion of a coil bolt after casting the product.

The plug of Ilukowicz is somewhat disadvantageous, however, since insertion and removal of the plug is time consuming. Additionally, the plug must be removed from the mold wall before it can be removed from the coil, since it can be removed only by being unscrewed from the insert coil. Every time a new concrete product is poured, therefore, the plug of Ilukowicz must be reattached to the mold wall.

It is seen, therefore, that there is a need for an improved plug assembly for positioning an edge pick-up insert in a mold as a concrete product is cast and for maintaining the coil of the insert free of concrete, but which plug assembly is capable of being inserted and removed quickly and easily from the insert. A need exists, as well, for a plug assembly which need not be removed from the mold wall after each product is cast.

SUMMARY OF THE INVENTION

A plug assembly for temporary use with a concrete product insert, including a coil defining an interior threaded surface, which insert is to be held in position adjacent a mold wall by the plug assembly during the pouring of the concrete product, includes a plug having a hollow, cylindrical elastomeric body. The body defines a cavity which is open at one end and closed at the other end, the outer surface of the body being proportioned and threaded for firm matching engagement with the threaded coil interior surface. The elastomeric body engages the interior surface of the insert coil upon a predetermined radial compression and axial expansion from the substantially unstressed condition of the body.

A stem is positioned in the cavity and is attached to the body internally at the closed end thereof. The stem extends out of the cavity through the open end of the body a distance which is sufficient to provide for use of the stem as a handle for applying a pulling force to the body. A support means having a first portion for insertion into the cavity through the opening and a second portion for attachment to a mold wall is arranged such that the support means may be removed from the cavity as the mold wall is removed from the concrete product. The plug may thereafter be removed from the coil by applying a pulling force to the stem.

The elastomeric body may have its outer surface threaded only adjacent its ends with the intervening outer surface being substantially smooth. The threaded end portions will therefore firmly engage the interior threaded surface of the coil and the plug may be adjusted with respect to the coil by rotation without the smooth intervening surface binding against the interior threaded surface.

The support means defines an opening into which the stem of the plug extends when the first portion of the support means is inserted into the cavity in the elastomeric body of the plug. A radially extending lug on the outer surface of the plug may be provided such that when the lug is positioned to engage the end of the wire coil, the insert will be properly positioned with respect to the mold wall.

The plug of the present invention may also be used with a concrete product insert of the type which rests upon the floor of a mold and which provides a coil insert at the upper surface of the poured concrete slab. A cavity closure means is positioned at the open end of the cavity in the body, surrounding the stem, such that the cavity will not be filled with concrete as the product is poured. The closure means may comprise a disc having a central opening for surrounding the stem, the diameter of the central opening being less than the unstressed diameter of the stem such that the closure means firmly engages the stem and is held thereby in the cavity opening.

Accordingly, it is an object of the present invention to provide a plug assembly for temporary use with a concrete product insert, including a coil defining an interior threaded surface, which will keep the interior of the coil free of concrete as the product is poured; to provide such an assembly which may be inserted into the coil and removed therefrom rapidly; to provide such a plug assembly which will hold the concrete product insert adjacent a mold wall and which will not require complete removal of the plug assembly from the mold wall prior to removal of the plug assembly from the coil insert; to provide such a plug assembly in which a support means is inserted into a cavity in the plug and maintains the interior of the insert coil free of concrete during pouring of the concrete product; and, to provide a cavity closure means which may be used with the plug of the present invention for sealing the opening into the body of the plug when such plug is to be used with a pick-up insert having leg portions which hold the insert on the floor of the mold and position the coil near the upper surface of the poured product.

These and other objects and advantages of the invention will be apparent from the following description, the accompanying drawings and the appended claims.

DETAILED DESCRIPTION OF THE PREFERRED EMBODIMENTS

Figure 1:
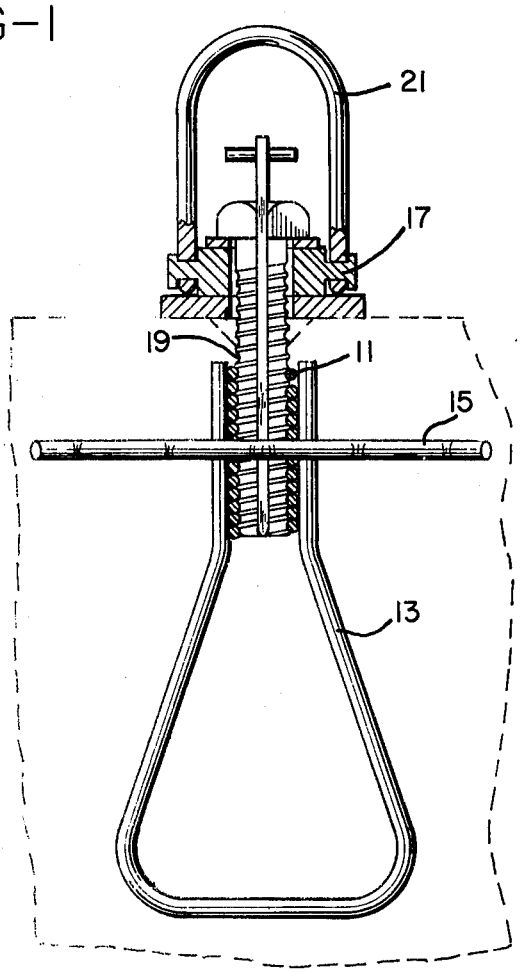
FIG. 1 is a plan view of an edge pick-up coil insert of the type used with the present invention and an attachment device engaging the insert before the product is erected.

FIG. 1 is a view of an edge lift coil insert and a lifting attachment mechanism of the type used in precast concrete building products. In this construction technique, concrete products which will ultimately form various portions of the finished structure are poured at a location which is remote from the construction site. The products are then transported by truck, or other means, to the building site and placed in final position in the structure.

In order to be able to transport and position a concrete building product at the job site, it is necessary to embed in each such product one or more inserts. A lifting plate or other lift mechanism is then attached to the insert and a crane cable is attached to the lifting plate. An insert generally includes a coil having a plurality of turns of heavy wire or rod stock which is welded to shapes of wire or rod stock which anchor the insert in the product.

An edge lift insert is shown in FIG. 1, as seen from above, prior to moving of the building product. The concrete product is shown only in phantom lines. The insert includes a coil 11 which is welded to an anchor means including a loop of wire 13 and a transverse rod 15. A swivel lift plate 17 is attached to the coil 11 by means of a split bolt mechanism 19 such as shown in U.S. Pat. No. 3,456,547, issued to Strong, or U.S. Pat. No. 3,922,946, issued to Grayson. Although split bolt mechanisms of the type therein disclosed can be more rapidly inserted and tightened into place than a conventional bolt, a solid bolt of appropriate dimensions and construction may be used as well for such connection. Loop 21 can be pivoted and provides a connection for a hook mechanism attached to the crane cable.

Figure 2:
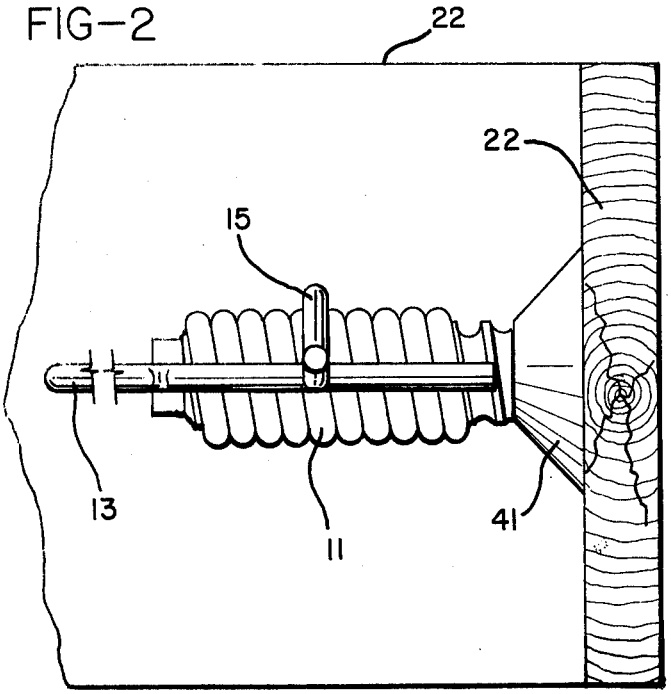
FIG. 2 is a side elevational view of an insert held in a concrete product mold by a plug assembly of the present invention prior to pouring the product.

As seen in FIG. 2, a side view of the coil insert and the plug assembly of the present invention in the product mold, the insert must be held in position adjacent the mold wall 22 prior to pouring the concrete product. An edge lift insert typically does not include leg members for supporting the insert before the product is poured and, therefore, this support must be provided by attaching the insert to the mold wall. Additionally, the interior of the coil must be kept free of concrete in order to permit a split bolt or solid bolt to be inserted subsequently for attachment of a lift mechanism.

Figure 3:
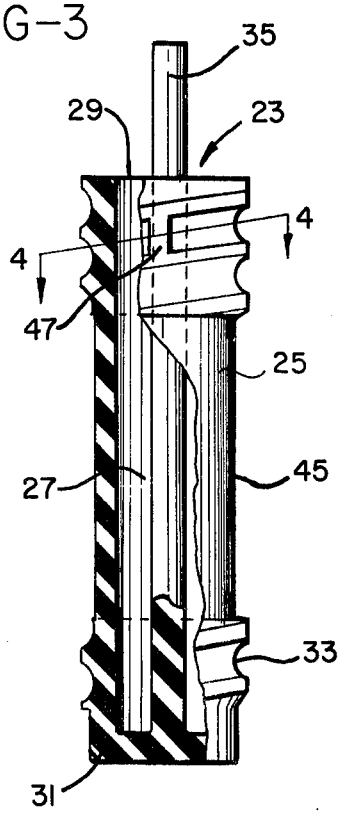
FIG. 3 is a view of the plug of the present invention with parts broken away and in section.
Figure 4:
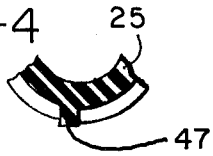
FIG. 4 is a partial sectional view taken along the line 4—4.
Figure 5:
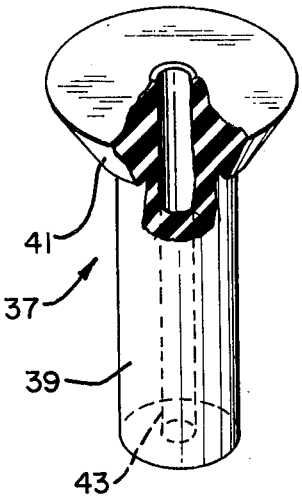
FIG. 5 is a perspective view of the support means of the present invention with portions broken away.

Reference is now made to FIGS. 3, 4 and 5 in which the plug assembly of the present invention is shown in greater detail. A plug 23 includes a hollow cylindrical elastomeric body 25 defining a cavity 27 and which defines and opening at one end 29 of the body, and which body is closed at the other end 31. The body 25 has an outer surface 33 which is proportioned and threaded for firm matching engagement with the interior surface of the coil upon predetermined radial compression and axial expansion from the substantially unstressed condition of the elastomeric body 25.

A stem 35 in cavity 27 is attached to the body 25 at the closed end 31 and extends out of the cavity 27 through open end 29 a distance sufficient to provide for use of the stem as a handle, as is described below. A support means 37 has a first portion 39 which is appropriately sized for insertion into cavity 27 through opening 29. Support means 37 also includes a second portion 41 which is provided for attaching the support means to a mold wall. An opening 43 in support means 37 is provided into which the stem 35 of the plug 23 may extend when the first portion 39 of support means 37 is inserted into cavity 27 in the elastomeric body 25.

The outer surface 33 of elastomeric body 25 may be threaded only adjacent its ends, with the intervening outer surface area 45 being substantially smooth. This improves the ease with which the plug assembly of the present invention may be adjusted, once it is positioned in the insert coil, as explained below. A radially extending lug 47, as shown in FIGS. 3 and 4, is provided on the surface 33. The purpose of the lug will also be described below.

Figure 6:
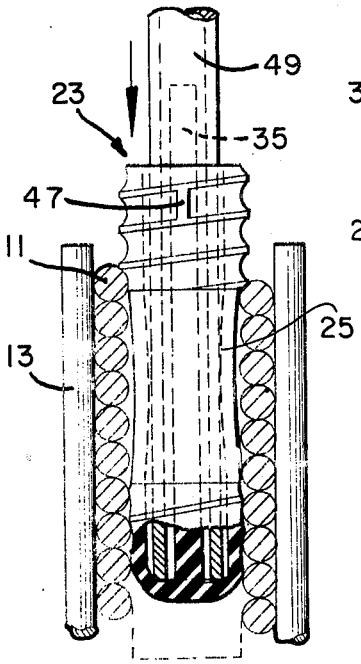
FIG. 6 illustrates the manner in which the plug of the present invention is inserted into the coil of a concrete product insert.
Figure 7:
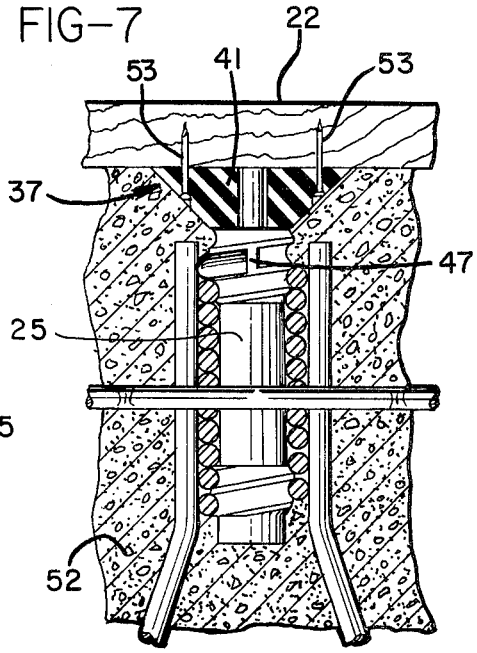
FIG. 7 is a sectional view, looking from above, of the coil insert and plug assembly of the present invention in the concrete product form after the product is poured.

Referring now to FIGS. 6 and 7, the method by which the plug of the present invention is inserted into the insert coil is illustrated. A hollow tube 49 is inserted into cavity 27 in body 25 and surrounds stem 35. Force is applied to the plug 23 by means of the tube 49 such that the plug 23 is compressed radially and expanded or stretched axially. The distortion in the shape of the outer surface of the plug 23 permits the plug to be forced directly into the interior of coil 11. Once the plug has been inserted a sufficient distance into the coil, the tube 49 is withdrawn. The plug then expands radially and engages firmly the interior threaded surface of the coil.

In order to position the plug precisely with respect to the insert coil, a lug 47 is provided, bridging one of the threads in the threaded portion of the plug exterior. The plug will be positioned correctly when the lug 47 engages the upper most end of the coil, 11, as shown in FIG. 7. After the plug 23 is inserted into the coil 11, its position may be adjusted slightly by rotating it with respect to the coil. The surface area 45 on the exterior of the plug 23 is substantially smooth so that it will not interfere with such rotation of the plug. If this area were not smooth, the central area of the plug exterior might not mesh correctly with the interior threaded surface of the coil, and rotation of the plug would be very difficult.

FIG. 7 is a plan view of the insert and the plug assembly of the present invention, positioned in a concrete product mold and attached to the mold wall 22 after concrete 52 has been poured. The second portion 41 of the support means 37 is attached by nails 53 to the mold wall 22. The support means 37 may, for instance, be formed of a hard rubber or plastic material having sufficient rigidity to support the insert prior to pouring of the concrete product. The support means may have holes formed in portion 41 to receive nails 53 or, alternatively, another method of attaching the support means to the mold wall may be provided. The first portion of the support means which is inserted into the plug is sized to seal the cavity 27 in the plug and thereby to prevent the entry of concrete as the product is poured.

Figure 8:
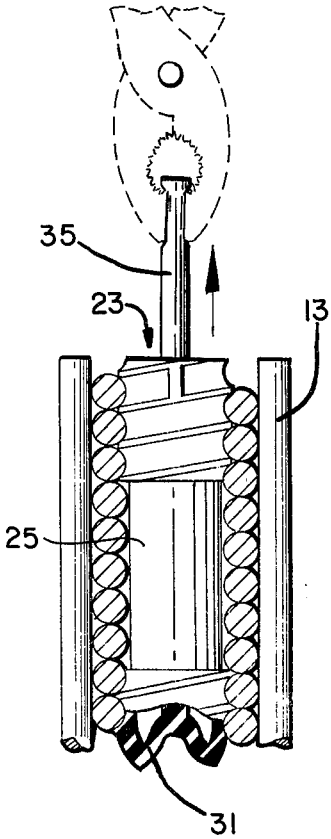
FIG. 8 illustrates the manner in which the plug assembly is removed from the insert after the product is poured.

After the concrete product has been poured and the concrete has been given sufficient time to harden, the mold is pulled away from the product. Since the support means 47 is attached to the mold wall, it will also be removed from the insert. The plug is then removed, as shown in FIG. 8. The stem 35 is used as a handle for applying a pulling force internally of the plug to the closed end 31 of the plug. This pulling force is sufficient to distort the exterior shape of the plug 23 and to cause end 31 to collapse partially and turn inside out as the plug is withdrawn.

It will be noted that both the support means 37 and the plug 23 are inserted and removed without rotation with respect to the insert, and that such insertion and removal are effected quickly and easily. It is quite common for a number of inserts to be positioned along the edge of a product, and two or more of these inserts may be welded together. The plug assembly of the present invention permits the mold wall to be withdrawn from the edge of the product with all of the support means 37 remaining attached thereto. Plugs 23 are then quickly removed, and the panel is ready to be erected after a coil bolt and lifting plate are attached.

Figure 9:
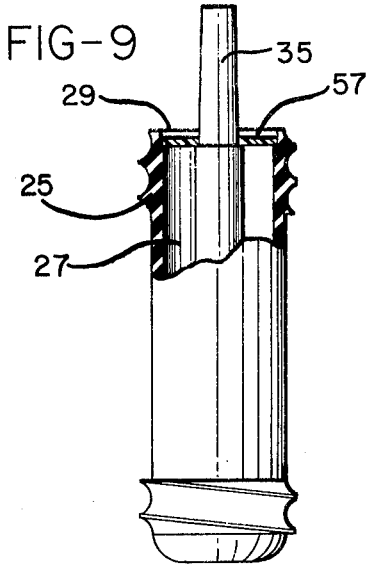
FIG. 9 shows a second embodiment of the invention suitable for use with inserts of the type which rest upon the mold floor and provide a means of attachment to the side of a slab or panel.
Figure 10:
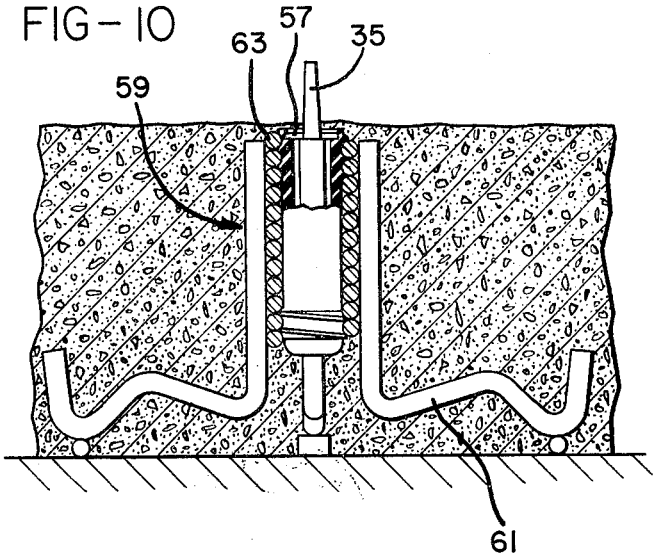
FIG. 10 is a sectional view with portions broken away illustrating the use of the embodiment of FIG. 9 in a coil insert.

A modification of the plug of the present invention is shown in FIGS. 9 and 10 which may be used with lift inserts of the type which rest upon the floor of a mold and are used in tilt-up construction. In this construction technique, panels which will ultimately form the building walls are poured at the job site on the floor slab of the building or in a mold adjacent the floor slab. After being poured and permitted to harden, these panels are then raised by means of a crane into their ultimate position in the building. The panels will then be shored up and eventually connected to the structural frame of the building.

In order to be able to raise the panels which are poured at the job site, it is necessary to embed in each panel a number of inserts. As with pre-cast products, a lifting plate or other lift mechanism is then attached to the insert and a crane cable is attached to the lifting plate. An insert generally includes a coil having a plurality of turns of heavy wire or rod stock which is welded to supporting leg members which anchor the insert in the product.

As seen in FIG. 9, the plug used with such an insert is similar to that shown in FIG. 3, with the exception that the stem 35 and body 25 define shoulders adjacent opening 29. A washer or other annular disc 57 acts as a cavity closure means for cavity 27 and is positioned at the open end of the cavity.

The washer 57 surrounds the stem 35 such that the cavity will not be filled with concrete as a concrete product is poured. The central opening in the washer 57 is smaller than the unstressed diameter of the stem 35 such that after the stem has been pulled therethrough, with resulting reduction in diameter, in expanding toward its normal unstressed condition it will be firmly engaged within that washer and thereby hold it in the cavity opening.

The manner in which this plug assembly is used is shown in FIG. 10. The lift insert 59 includes leg portions 61 which are welded to coil 63. The plug assembly is inserted into the coil 63 in a manner identical to that illustrated in FIG. 6. After insertion and position of the plug, the stem 35 is stretched slightly, reducing its diameter and permitting washer 57 to be appropriately positioned on the stem. The lift insert 59 is then positioned on the floor of the slab mold and the slab is poured. The upper surface of the slab is smoothed using screeding techniques which will prevent crowns in the slab. The tip of stem 35 is flexible such that it will not interfere with screeding but will rise up sufficiently to identify the location of the insert. After the slab has hardened, the thin layer of concrete covering the plug assembly is chipped away, and the plug is removed by applying a pulling force to stem 35 in a manner similar to that illustrated in FIG. 8. A split bolt or other attachment mechanism may be inserted into coil 63 and the slab attached thereby to a crane line.

While the forms of apparatus herein described constitute preferred embodiments of this invention, it is to be understood that the invention is not limited to those precise forms of apparatus, and that changes may be made therein without departing from the scope of the invention.

I claim:

1. A plug assembly for temporary use with a concrete product insert including a coil defining an interior threaded surface, which insert is to be held in position adjacent a mold wall by said plug assembly during the pouring of a concrete product, comprising:

(a) a plug including a hollow cylindrical, elastomeric body defining a cavity and an opening thereto at one end of said body, said body closed at the other end thereof, and said body having an outer surface proportioned and threaded for firm matching engagement with said threaded coil interior surface upon predetermined radial compression and axial expansion from the substantially unstressed condition of said elastomeric body, and a stem in said cavity attached to said body internally at said closed end thereof and extending out of said cavity through said opening a distance sufficient to provide for use of said stem as a handle for applying a pulling force internally of said plug to said closed end thereof, and (b) support means having a first portion inserted into said cavity through said opening and a second portion for attachment to a mold wall such that said support means may be removed from said cavity as said mold wall is removed from said concrete product and said plug may be thereafter removed from said coil by applying a pulling force to said stem.

2. The plug assembly of claim 1 in which said outer surface of said elastomeric body is threaded only adjacent its ends and in which the intervening outer surface is substantially smooth, such that the ends of said outer surface of said elastomeric body firmly engage said interior threaded surface of said coil and the position of said plug may be adjusted with respect to said coil by rotation of said plug without said smooth intervening surface binding against said interior threaded surface.

3. The plug assembly of claim 1 in which said support means defines an opening into which said stem of said plug may extend when said first portion of said support means is inserted into said cavity in said elastomeric body of said plug.

4. The plug assembly of claim 1 further comprising a radially extending lug on said outer surface of said plug, said lug being positioned to engage the end of said coil such that said insert will be properly positioned with respect to said mold wall.

5. A coil insert assembly for use in a concrete product to provide a means for receiving a coil bolt, said coil insert assembly adapted to be supported by a mold wall in a mold as the concrete product is poured, comprising:

a cylindrical wire coil of a predetermined number of turns cooperating to define an interior threaded surface of a predetermined diameter sized for threadedly receiving a coil bolt, anchor means attached to said wire coil for firmly anchoring said coil in the formed concrete product, a plug filling said coil and engaging said interior threaded surface, said plug including a hollow, substantially cylindrical, elastomeric body defining a central cavity and an opening thereto at one end of said body, said body closed at the other end thereof, and said body having an outer surface defining threads for engaging said interior threaded surface of said coil upon predetermined radial compression and axial expansion from the substantially unstressed condition of said body, the exterior diameter of said plug in said unstressed condition being greater than said predetermined diameter of said interior threaded surface, and a stem in said cavity attached to said body internally at said closed end thereof and extending out of said cavity through said opening a distance sufficient for use of said stem as a handle for applying a pulling force internally of said plug to said closed end thereof, and support means having a first portion extending into said cavity through said opening and a second portion for attachment to a mold wall, such that said coil insert assembly may be supported in said mold as said concrete product is formed, said support means may be removed from said cavity as the mold wall is removed from said concrete product, and said plug may thereafter be removed from said coil by applying a pulling force to said stem.

6. The coil insert assembly of claim 5 in which said first portion of said support means is sized effectively to seal said opening such that concrete will not flow into said cavity as said product is poured.

7. The coil insert assembly of claim 5 in which said support means defines an opening for receiving said stem as said first portion of said support means is inserted into said cavity defined by said elastomeric body.

8. The coil insert assembly of claim 5 in which said plug is substantially longer than said coil and in which said first portion of said support means extends beyond said cylindrical wire coil such that said elastomeric body is not collapsed by the poured concrete which surrounds said body.

9. The coil insert assembly of claim 5 further comprising a radially extending lug on said outer surface of said elastomeric body, said lug being spaced a predetermined distance from the end of said body such that upon engagement of said lug at the end of the wire coil, said coil will be positioned appropriately in said finished concrete product.

10. The coil insert assembly of claim 5 in which said outer surface of said elastomeric body is threaded only adjacent the ends of said body such that the intervening outer surface of said elastomeric body will not bind said plug.

11. A plug assembly, for temporary use with a concrete product insert including a coil defining an interior threaded surface, comprising:

(a) a plug including a hollow cylindrical, elastomeric body defining a cavity open at one end of said body and closed at the other end thereof, said body having an outer surface proportioned and threaded for firm matching engagement with said threaded coil interior surface upon predetermined radial compression and axial expansion from the substantially unstressed condition of said elastomeric body, and a stem in said cavity, attached to said body internally at said closed end thereof and extending out of said cavity through said open end thereof a distance sufficient to provide for use of said stem as a handle for applying a pulling force internally of said plug to said closed end thereof, and (b) cavity closure means positioned at the open end of said cavity in said body and surrounding said stem such that said cavity is not filled with concrete as the concrete product is poured.

12. The plug assembly of claim 11 in which said cavity closure means comprises a disc having a central opening for surrounding said stem, the diameter of said central opening being less than the unstressed diameter of said stem such that said closure means firmly engages said stem and is held thereby at the open end of said cavity.

* * * * *